US005865909A

United States Patent [19]

Meyer et al.

[11] Patent Number: 5,865,909

[45] Date of Patent: Feb. 2, 1999

[54] BORON MODIFIED MOLYBDENUM SILICIDE AND PRODUCTS

[75] Inventors: Mitchell K. Meyer, Idaho Falls, Id.; Mufit Akinc, Ames, Iowa

[73] Assignee: Iowa State University Research Foundation, Inc., Ames, Iowa

[21] Appl. No.: 699,647

[22] Filed: Aug. 19, 1996

Related U.S. Application Data

[63] Continuation-in-part of Ser. No. 513,682, Jul. 28, 1995.

[51] Int. Cl.[6] ..... C22C 27/04

[52] U.S. Cl. ..... 148/423; 420/429

[58] Field of Search ..... 148/407, 423; 420/429

[56] References Cited

U.S. PATENT DOCUMENTS 5,580,518 12/1996 Thom et al. ..... 420/417
5,595,616 1/1997 Berczik ..... 420/429

FOREIGN PATENT DOCUMENTS

85/03953 9/1995 WIPO .

OTHER PUBLICATIONS

Contributions to the Nowotny Phases; Powder Metallurgy Bulletin vol. B, (1957), pp. 23–34, Parthe.

Lattice Dimensions of Low–Rate Metalloid–Stabilized $Ti_5Si_3$; High Temperatures—High Pressures, 1974, vol. 6, pp. 515–517, Quakernaat, et al.

Electronic Structure and Alloy Chemistry of the Transition Elements; J. Wiley & Sons, 1963, pp. 204–205, Hans Nowotny.

Metals and Alloys;, Acta. Cryst., vol. 10, 1957, pp. 768–769, Parthe.

An Investigation of Boride Cermets; Ceramic Bulletin, vol. 35, No. 2 (1956), pp. 47–52, Stavrolakis, et al.

A New Carbide–Base Cermet Containing TiC, $TiB_2$, and CoSi; J. of American Ceramic Society, vol. 37, No. 5, May 1, 1954, pp. 203–206, Greenhouse, et al.

Oxidation Resistances of Ternary Mixtures of the Carbides of Titanium, Silicon, and Boron; J. of American Ceramic Society, vol. 37, No. 4, Apr., 1954, pp. 173–177; Accountius, et al.

Untersuchungen in den Dreistoffsystemen: Molybdaen–Silizium–Bor Wolfram–Silizium–Bor und in dem System: $VSi_2$–$TaSi_2$; Moratscheft Fur Chemie, 88, 180 (1957), and translation attached thereto.

(List continued on next page.)

*Primary Examiner*—George Wyszomierski
*Attorney, Agent, or Firm*—Edward J. Timmer

[57] ABSTRACT

A boron-modified molybdenum silicide material having the composition comprising about 80 to about 90 weight % Mo, about 10 to about 20 weight % Si, and about 0.1 to about 2 weight % B and a multiphase microstructure including $Mo_5Si_3$ phase as at least one microstructural component effective to impart good high temperature creep resistance. The boron-modified molybdenum silicide material is fabricated into such products as electrical components, such as resistors and interconnects, that exhibit oxidation resistance to withstand high temperatures in service in air as a result of electrical power dissipation, electrical resistance heating elements that can withstand high temperatures in service in air and other oxygen-bearing atmospheres and can span greater distances than $MoSi_2$ heating elements due to improved creep resistance, and high temperature structural members and other fabricated components that can withstand high temperatures in service in air or other oxygen-bearing atmospheres while retaining creep resistance associated with $Mo_5Si_3$ for structural integrity.

10 Claims, 6 Drawing Sheets

OTHER PUBLICATIONS

Evaluation of $A_5Si_3Z_x$ Intermetallics for Use as High Temperatures Structural Materials; published Jul., 1994, 26 pages; Thom, Meyer, Kim and Akinc.

"Creep Resistance of Boron Doped $Mo_5Si_3$", American Ceramic Soc. 97th, Annual Meeting, Cincinnati, Apr. 30–May 3, 1995, Meyer et al.

"Oxidation Resistance and Compressive Creep Behavior of Boron Doped $Mo_5$ $Si_3$" Advanced Ceramic for Structural and Tribological Applications, Aug. 23, 1995, Meyer et al.

"Compressive creep behavior of $Mo_5Si_3$ with the addition of boron", Intermetallic 4, 1996, Meyer et al.

"The Potential For Use of $Mo_5Si_3$ In High Temperature Applications" American Ceramic Soc, Annual Meeting, Apr. 26, 1994, Meyer et al.

BORON MODIFIED MOLYBDENUM SILICIDE AND PRODUCTS

This application is a continuation-in-part of copending application Ser. No. 08/513 682, filed Jul. 28, 1995.

CONTRACTURAL ORIGIN OF THE INVENTION

The United States Government has rights in this invention pursuant to Contract No. W-7405-Eng-82 between the Department of Energy and Iowa State University, which contract grants to the Iowa State University Research Foundation, Inc. the right to apply for this patent. The research leading to the invention was supported in part by the U.S. Department of Commerce Grant ITA 87-02.

FIELD OF THE INVENTION

The present invention relates to high temperature materials and, more particularly, to boron-modified molybdenum silicide material having improved oxidation resistance and high temperature creep resistance as well as to high temperature products made therefrom.

BACKGROUND OF THE INVENTION $Mo_5Si_3$ is an intermetallic compound having high hardness, high melting point, and good high temperature creep resistance. The creep resistance of $Mo_5Si_3$ has been shown to be better than that of $MoSi_2$ which is material commonly used in high temperature non-load bearing service applications as a result of its excellent oxidation resistance. However, $MoSi_2$ has found limited use in load bearing applications as a result of its high creep rate at elevated temperatures, such as greater than about 1000 degrees C.

Although the $Mo_5Si_3$ intermetallic compound exhibits good high temperature creep resistance, it unfortuantely exhibits relatively poor high temperature oxidative stability. For example, above about 1000 degrees C., the $Mo_5Si_3$ compound exhibits catastrophic oxidation and loss of structural integrity. The inadequate high temperature oxidative stability or resistance of the $Mo_5Si_3$ compound has limited its use in high temperature service applications. Moreover, at about 800 degrees C., $Mo_5Si_3$ exhibits a sudden drop in mass due to oxide scale spallation, and the oxidation rate is accelerated relative to 900–1000 degrees C.

It is an object of the present invention to provide a molybdenum silicide material and products thereof having substantially improved oxidative stability at elevated temperatures, such as exceeding about 1000 degrees C., while maintaining the good high temperature creep resistance associated with $Mo_5Si_3$ material.

SUMMARY OF THE INVENTION

The present invention provides a boron-modified molybdenum silicide material having the composition comprising about 80 to about 90 weight % Mo, about 10 to about 20 weight % Si, and about 0.1 to about 2 weight % B and a microstructure including $Mo_5Si_3$ phase as at least one microstructural component effective to impart good high temperature creep resistance. The boron-modified molybdenum silicide material is fabricated pursuant to the present invention into such products as electrical components, such as resistors and interconnects, that exhibit oxidation resistance to withstand high temperatures in service in air as a result of electrical power dissipation, electrical resistance heating elements that can withstand high temperatures in service in air and other oxygen-bearing atmospheres and can span greater distances than $MoSi_2$ heating elements due to improved creep resistance, and high temperature structural members and other fabricated components that can withstand high temperatures in service in air or other oxygen-bearing atmospheres while retaining creep resistance associated with $Mo_5Si_3$ for structural integrity. In a particular embodiment pursuant to the present invention, a molybdenum silicide material having the aforementioned composition includes a multiphase microstructure having unexpectedly substantially improved oxidative stability at elevated temperatures, such as exceeding about 800 degrees C. and above, such as exceeding 1450 degrees C., while having good high temperature creep resistance associated with $Mo_5Si_3$ at such elevated temperatures.

The above objects and advantages of the present invention will become more readily apparent form the following detailed description taken with the following drawings.

DESCRIPTION OF THE INVENTION

Figure 1:
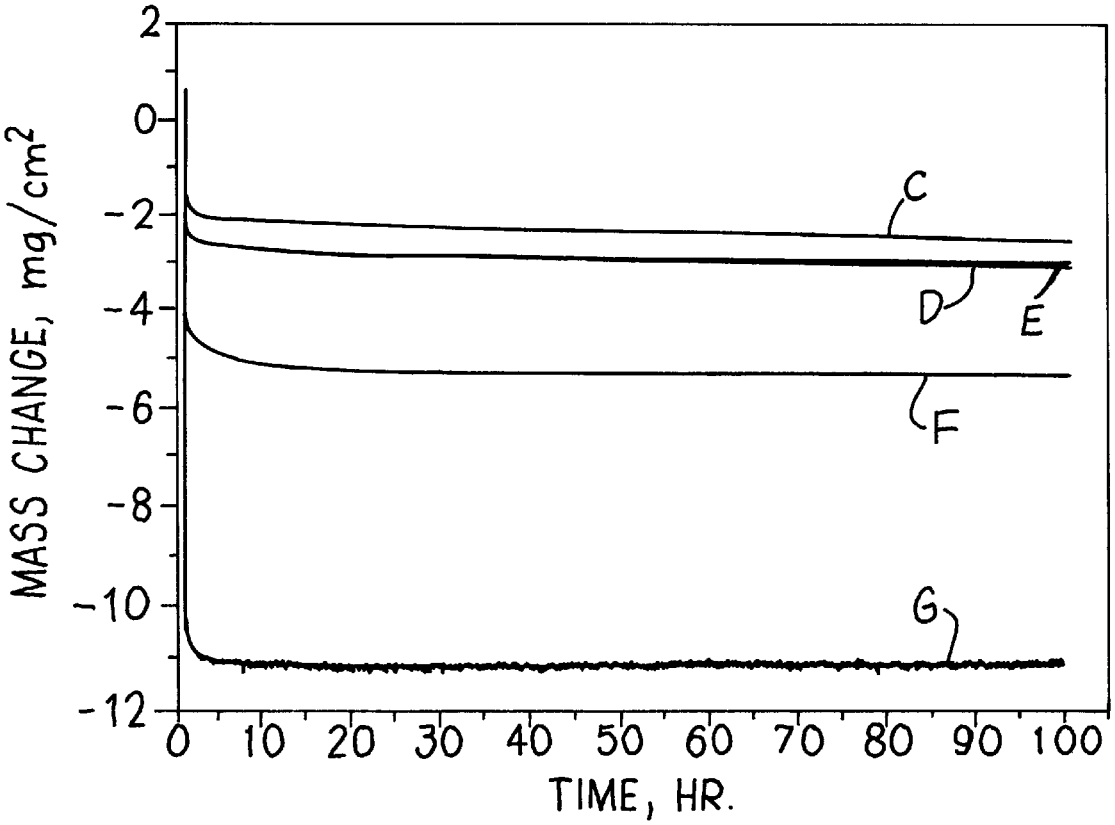
FIG. 1 includes graphs of mass change versus time at 1000 degrees C. in oxidation tests for boron-modified molybdenum silicide materials pursuant to the invention.

The present invention involves boron-modified molybdenum silicide material having the composition comprising about 80 to about 90 weight % Mo, about 10 to about 20 weight % Si, and about 0.1 to about 2 weight % B and a microstructure including $Mo_5Si_3$ phase as at least one microstructural component effective to impart good high temperature creep resistance. Set forth in Table I below are exemplary compositions of boron-modified molybdenum silicide materials (measured by inductively coupled plasma atomic emission spectroscopy ICP-AES) illustrative of the invention selected to provide a range of microstructural, total atomic fractions of Si and B relative to Mo, and ratio of B to Si.

TABLE I

Compositions of Mo—Si—B intermetallics.

| Specimen | Composition* Mo | Si | B |
|---|---|---|---|
| A | 82 | 16.1 | 1.24 |
| B2 | 85.7 | 13.0 | 1.3 |
| C | 81.2 | 18.2 | 0.61 |
| D | 81.5 | 18.3 | 0.14 |
| E | 82.2 | 16.9 | 0.91 |
| F | 86.3 | 12.6 | 1.1 |
| G | 88.2 | 10.8 | 1.0 |

*All compositions analyzed by ICP-AES.
All analysis ±3 wt % relative to analyzed element.

The exemplary boron-modified molybdenum silicide materials of Table I were synthesized by arc melting of the elemental components (e.g. Mo, Si, and B) on a water cooled copper hearth by energization of a tungsten electrode in a non-consumable tungsten arc melt furnace under argon atmosphere. Arc melting was performed 2–5 times to homogenize each melt of material. Each melt was solidified on the copper hearth as buttons. The Mo source comprised Mo foil of 99.95% purity from Philips Elmet, Lewiston, ME. The Si source comprised 3–20 millimeter pieces of Si of 99.995% purity from Alpha Chemcials, Danvers, Mass. The B source comprised 2–3 millimeter pieces of B of 99.5% purity from Alfa AESAR, Ward Hill, Mass.

Table I sets forth the results of chemcial anaylsis by inductively coupled plasma atomic emission spectroscopy (ICP-AES) for the arc melted materials.

The resulting arc melted/soldified button of each boron-modified molybdenum silicide material was ground to sub-micron size powders in a tungsten carbide lined impact mill (Model 2000 Mixer/Mill, SPEX Industries, Edison, N.J.) using tungsten carbide impact media. One weight percent cellulose ether (Methocel from Dow Corning Corporation, Midland, Mich.) was added to the material during milling to prevent powder agglomeration during milling. Resulting powders were seived through −635 mesh (less than 20 microns seive openings) after milling and cold pressed (room temperature) into 0.95 centimeter (cm) diameter and about 0.5 cm long pellet samples at 50 MPa. The pellet samples then were heated under argon at 5 degrees C. per minute to 600 degrees C. for two hours to burn off the cellulose ether added during grinding. The pellet samples then were sintered under high purity argon at 1800 degrees C. to a density greater than 90% of theoretical. To futher densify the pellet samples, they were hot isostatically pressed at 1750 degrees C. and 280 MPa without a container. The pellet samples were annealed at 1600 degrees C. for 24 hours under high purity argon at 1600 for 24 hours under high purity argon to obtain chemical and microstructural homogeneity.

Oxidation test coupons having a 1 millimeter thickness were cut using a diamond saw from the pellet smaples made in the above described manner. Coupons were polished in successive steps using 0.3 micron alumina and ultrasonically cleaned and rinsed in distilled water. The coupons were rinsed in ethanol, acetone, and hexane and dried at 105 degrees C. in air before high temperature oxidation testing.

Microstructural phase arrays of the oxidation coupons cut from the pellet sample materials of Table I made in the manner described were determined by using X-ray diffraction (XDS 2000 from Scintag USA, Sunnyvale, Calif.), scanning electron microscopy (JSM 6100 from JEOL USA, Peabody, Mass.), and energy dispersive spectroscopy Pentafet detector from Oxford Instruments, Oak Ridge, Taee.). Samples used for scanning electron microscopy (SEM) and energy dispersive spectroscopy (EDS) were etched with an etchant (Murakami's etch-10 grams of potassium hydroxide and of potassium ferricyanate) to better differentiate between a ternary so-called T2 phase and $Mo_3Si$ phases, which have nearly the same BSE (back scattered electron) contrast. The etchant selectively attacks the T2 phase and also a MoB phase which may be present. Table II below sets forth microstructural data from the above described analyses of the oxidation coupons.

Thermogravimetric oxidation tests were used to observe transient oxidation behavior and to determine isothermal oxidation rates. Coupons were suspended from a sapphire wire in a vertical tube thermogravimetric analyzer (System, 3, Cahn Instruments, Cerritos, Calif.). A small hole was spark machined through the coupons to provide means for hanging each coupon from the sapphire wire. The specimen chamber was purged for 2 hours with synthetic air before each test run. Coupon temperature then was increased at a rate of 20 degrees C. per minute to the oxidation temperature and held at temperature for 100 hours. Coupon mass change and temperature were continuously recorded. Following oxidation test runs, coupons were characterized for scale composition and microstructure using SEM, EDS, X-ray diffraction, and ESCA techniques (electron spectroscopy for chemical analysis, PHI 5500, Perkin Elmer, Minneapolis, Minn.)

The oxidation coupons having the compositions of Table I exhibited different multiphase microstructures; namely, 1) generally $Mo_5Si_3$ single phase material with boron in solid solution (also referred to as T1 phase), 2) $Mo_5Si_3$ matrix material with additional phases, and 3) $Mo_3Si$ matrix material with additional phases as summarized in Table II. All compositions contained a small amount of glassy phase.

TABLE II

Phase arrays of oxidation coupons[1]

| Composition | $Mo_5Si_3$ | T2 | $Mo_3Si$ | $MoSi_2$ | MoB |
|---|---|---|---|---|---|
| C | M | | | X | X |
| D | M | | | X | X |
| E | M | | | X | 2 |
| F | M | 2 | 2 | | |
| G[2] | 2 | 2 | M | | |

[1]M = matrix phase, 2 = major second phase, x = minor phase.
[2]XRD indicates that a small amount of metallic molybdenum is also present.

In Table II, T2 phase is thought to comprise ternary $Mo_5SiB_2$ or $Mo_5(Si,B)_3$. Compostions C and D had the lowest Mo and highest Si levels but differ substantially in B content (see Table I), producing different microstructures. Composition C had a three phase microstructure mixture with an $Mo_5Si_3$ matrix (T1) and MoB and $MoSi_2$ as minor second phases. A substantial amount of borosilicate glass was found by SEM/EDS as an impurity phase. X-ray diffraction analysis indicated that composition D was nearly phase pure $Mo_5Si_3$ although some MoB second was seen in BSE images. Also present was a smaller amount of borosilicate glass phase than found in composition I. Composition E was an $Mo_5Si_3$ matrix (T1) similar in microstructure to compostion C, but with a lower Si and higher B content. It did not contain a glassy impurity phase. Composition F was three phase $Mo_5Si_3$ matrix (T1) with $Mo_3Si$ and ternary T2 phase as dispersed phases. Composition G comprised a $Mo_3Si$ matrix material with T1 phase and T2 phase as major secondary phases (e.g. about 25 volume % each). Composition A was similar in microstructure to composition E. Composition B2 exhibited a microstructure similar to that of composition F (e.g. $Mo_5Si_3$ matrix phase (T1) at about 54 volume % of the microstructure and T2 phase and $Mo_3Si$ phase as secondary phases at 23 volume % each).

Figure 2:
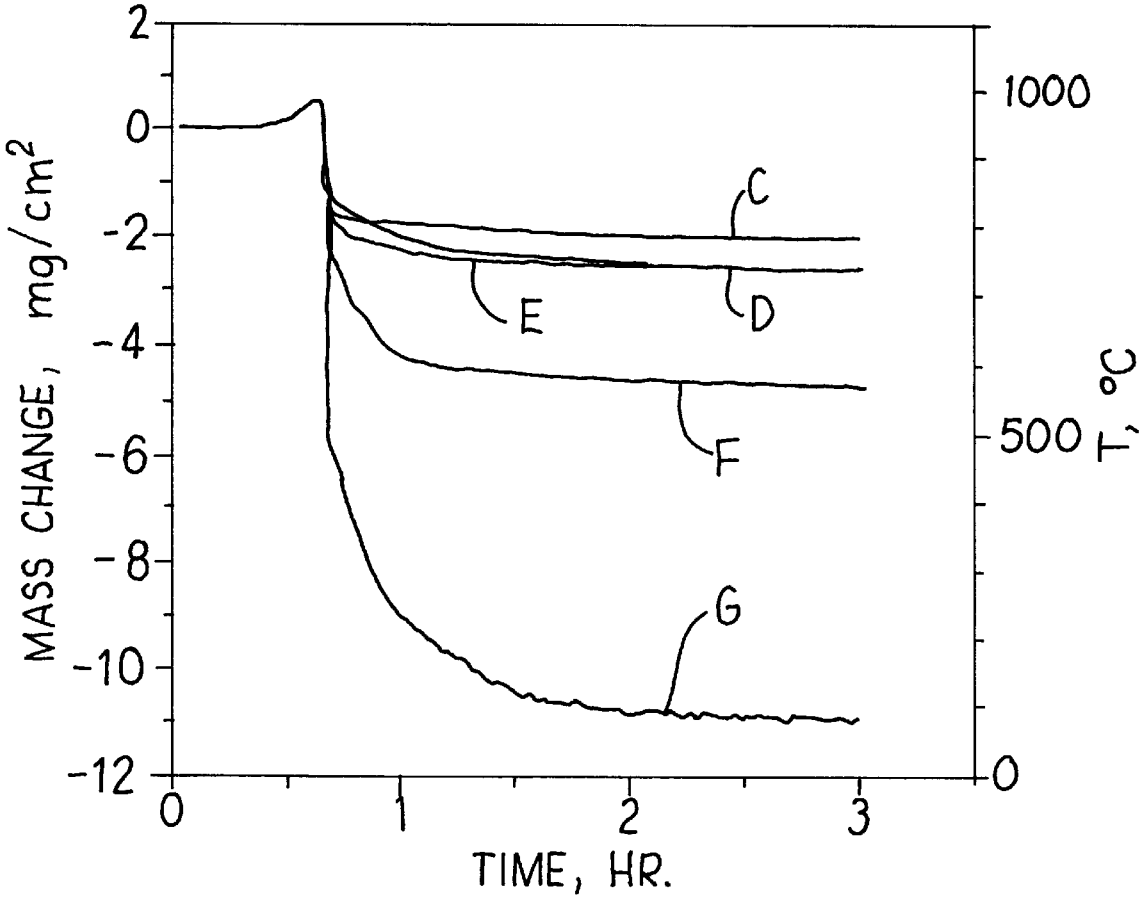
FIG. 2 includes graphs of mass change versus time for the materials during initial oxidation when the temperature is increasing, showing relative mass loss in the initial transient oxidation regime.
Figure 3:
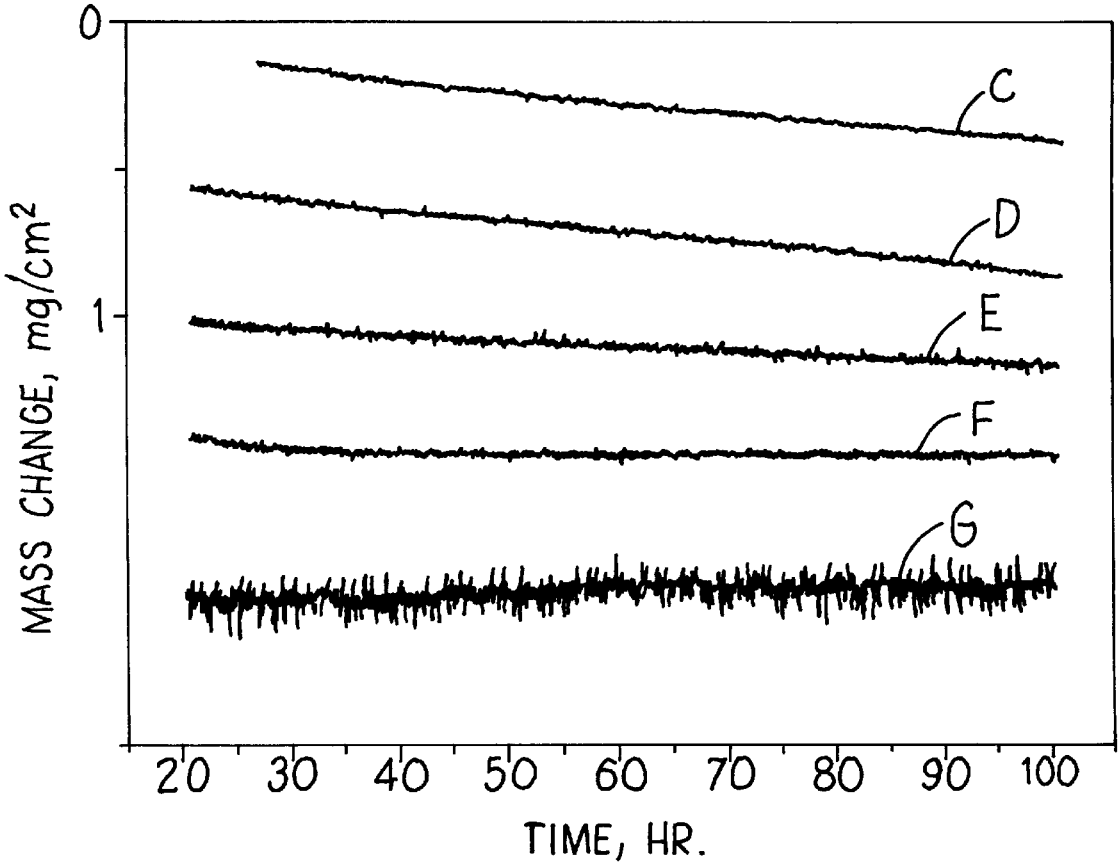
FIG. 3 includes graphs of mass change versus time for the materials during the steady state portion of oxidation.

FIG. 1 is a plot of the isothermal mass change on oxidation at 1000 degrees C. in air for compositions C, D, E, F, and G of Table I. All coupons exhibited an initial mass gain followed by a rapid mass loss starting at 750 degrees C., as shown in FIG. 2. After some period of rapid mass loss, oxidation proceeded at some relatively slower, steady state rate, FIG. 3. Inital mass loss and steady state oxidation rate are set forth in Table III. The inital mass gain appears to be due to formation of Si and Mo, and the mass loss appears to be due to volatilization of molybdenum oxide, although Applicants do not intend or wish to be bound by any theory in this regard.

TABLE III

| Initial mass loss and steady state oxidation rates | | |
|---|---|---|
| Composition | Initial mass loss, $mg/cm^2$ | Steady state[1] rate, $mg/cm^2 \cdot hr$ |
| C | 2.77 | $-3.34 \times 10^{-3}$ |
| D | 2.15 | $-3.63 \times 10^{-3}$ |
| E | 2.79 | $-1.9 \times 10^{-3}$ |
| F[2] | 5.29 | $-5.0 \times 10^{-5}$ |
| G | 11.2 | $+7.3 \times 10^{-4}$ |

[1]20–100 hrs.
[2]30–100 hrs.

Figure 4:
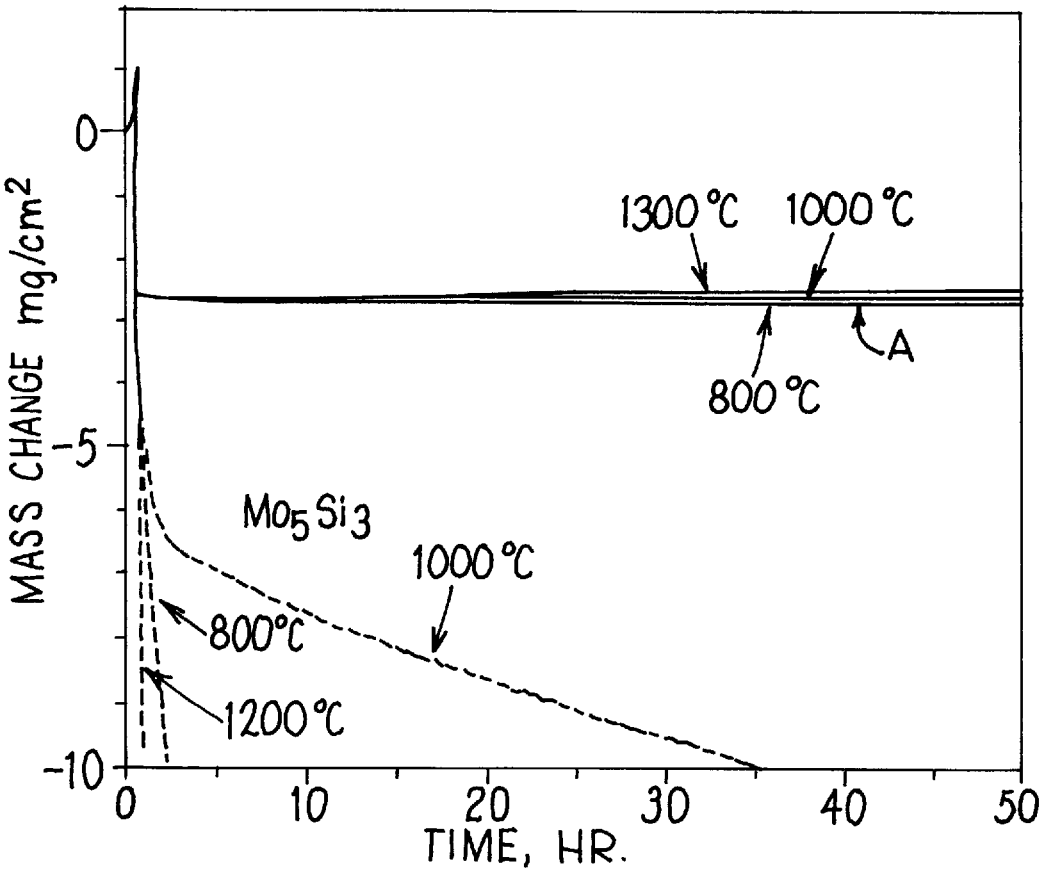
FIG. 4 includes graphs of mass change versus time at different temperatures in oxidation tests for boron-modified molybdenum silicide materials pursuant to the invention and for $Mo_5Si_3$ free of boron for comparison.

The steady state portion of the oxidation curves for compositions C, D, E, F, and G are shown in FIG. 4. The curves are shifted to more clearly illustrate the differences in rates of oxidation. Oxidation rates shown in Table III were arrived at by assuming a linear model for oxidation kinetics from 20–100 hours. However, no significance should be given to the choice of a linear model other than to give comparative mass change rates. Compositions C, D, and E exhibited a mass loss over the duration of the oxidation tests. Composition F showed a mass loss over the first 32 hours of oxidation followed by a period of almost zero net mass change. Composition G showed a small positive mass change on oxidation.

In summary, oxidation of all of compositions C, D, E, F, and G of Table I proceeded in two stages involving an intial transient period followed by a region of steady state oxidation. The inital transient period is characterized by a mass gain starting at about 600 degrees C. followed by a rapid mass loss starting at about 750 degrees C. In some cases (i.e. compositions A and C), transient mass loss is relatively small and essentially complete by about 850 degrees C., indicating rapid formation of a protective scale. In other cases (i.e. compositions F and G), transient mass loss continues well into the isothermal temperature regime. After the initial transient oxidation period, the rate of mass loss decreases by several orders of magnitude, however.

Compositions with a higher relative fraction of B and Si exhibited initial formation of a scale at 600 degrees C. with a large fraction of borosilcate glass and finely mixed oxide and a smaller fraction of "pure" molybdenum oxide. The change from the initial transient oxidation period to a region of slower mass loss occured at about 800 degrees C., indicating that the transient mass loss is due to volatization of $MoO_3$ originally formed in the scale at 600 degrees C., and that rapid active oxidation of Mo was not occurring at greater than 800 degees C.

Compositions containing between about 10.0 and 20.0 weight % Si and having B/Si ratios between about 0.03 and 0.1 are preferrred. As evidenced by Tables I–III and FIGS. 1–4, the optimum ratio of B/Si decreases from 0.093 at 10.8 weight % Si (G) to as low as 0.008 at 18.3 weight % Si (D) for good oxidation resistance.

After the transient oxidation period, a slower steady state regime was reached. The isothermal oxidation data at 1000 degrees C. was found to vary inversely with scale viscosity. The microstructural phase array of the substrate coupon did not have an effect on long term oxidation behavior. Of the binary silicides, $Mo_3Si$ has the poorest oxidation resistance. Composition G, however, which has the largest fraction of $Mo_3Si$ had the lowest steady state oxidation rate. This indicates that flow of the scale including borosilicate glass to form a coherent passivating layer is more important than the diffusion rate of Si to the interface in determining oxidation behavior at 1000 degrees C.

Referring to FIG. 4, graphs of oxidation induced mass change versus time for boron-free $Mo_5Si_3$ and boron modified compositon A of Table I are shown at 800–1300 degrees C. The boron-free $Mo_5Si_3$ test coupons were made from powder $Mo_5Si_3$ material in a manner similar to that described above for the boron modified compositions. These graphs include the initial ramping up to temperature at 20 degrees per minute. Rate constants for oxidation of $Mo_5Si_3$ and boron modified compositon A are given in Table IV.

TABLE IV

Rate constants for the oxidation of $Mo_5Si_3$ based materials.

| Temperature, °C. | Kinetic model | Steady state* rate constant | Run time, hr. |
|---|---|---|---|
| $Mo_5Si_3$ | | | |
| 800 | none | pest | 35 |
| 1000 | linear | $-7.2 \times 10^{-2}$ | 80 |
| 1100 | linear | $-2.9 \times 10^{+1}$ | 10 |
| 1200 | linear | $-1.3 \times 10^{+3}$ | 3 |
| B—$Mo_5Si_3$ (A) | | | |
| 800 | linear | $-6.0 \times 10^{-4}$ | 15–150 |
| 1000 | linear | $-4.4 \times 10^{-5}$ | 410 |
| 1100 | parabolic | $+5.9 \times 10^{-5}$ | 300 |
| 1300 | parabolic | $+2.8 \times 10^{-4}$ | 115 |

*Rate constants given in units of $mg\ cm^{-2}\ hr^{-1}$ for linear rates and $mg^2\ cm^{-4}\ hr^{-1}$ for parabolic rates. Negative rate indicates mass loss.

From FIG. 4, it is apparent that addition of boron to $Mo_5Si_3$ provides a significant increase in oxidation resistance. At 800 degrees C., no pesting behavior (characterized by formation of powdery $MoO_3$ and silica formation) is observed in contrast to boron-free $Mo_5Si_3$ which exhibits such behavior. At 800–1000 degrees C., slow mass loss occurs in the isothermal oxidation regime. A scale free of molybdenum oxide and thickness on the order of 8 microns is formed in contrast to boron-free $Mo_5Si_3$ which forms a scale including needle-like molybdenum oxide crystals. The scale of boron-modified composition A showed no signs of cracking or porosity. In the range of 1050–1300 degrees C., boron-modified composition A coupons show a slow mass gain at long times. The mass gain on oxidation at 1100 degrees C. is approximately 0.05 milligrams per centimeters squared over 50 hours.

For boron free $Mo_5Si_3$, the oxidation rate at 1000 degrees C. is slow relative to that at 800 degrees C. but much too fast for consideration as a useful high temperature oxidation resistant material.

Oxidation rate data at 1000 degrees C. for other boron modified compositions (see Table I) are set forth below in Table IV. An improvement in oxidation resistance is attained over a wide range of sample compositions and microstructures. ESCA analysis indicated that the scale surface resembled borosilicate glass in chemical bonding, and that the B/Si ratio in the scale is proportional to the B/Si ratio in the substrate. Preferred B/Si ratios for use in practicing the invention are discussed above.

Mass gain on oxidation, the formation of a molybdenum interlayer, and scale morphology indicate that oxygen diffusion through a coherent scale is the rate limiting step in the oxidation behavior of boron modified $Mo_5Si_3$ compositions of Table I at 1050–1300 degrees C., although Applicants do not wish or intend to be bound by any theory in this regard. The growth of a coherent scale as a result of boron additions is attributed to formation of a low viscosity borosilcate glass scale which can flow to close pores that initially form in the coating, although Applicants do not wish or intend to be bound by any theory in this regard.

Compressive creep testing was carried out at constant stress under flowing argon using a feedback controlled electromechanical system to apply load. Experiments were conducted at temperatures of 1220–1320 degrees C. and stresses of 140–180 MPa (20.3–26.1 ksi). Creep specimens were held at constant stress and temperature until approximately 1% strain was measured, at which time temperaure was increased 20 degrees C., and another data point taken. Microstructures were characterized before and after creep testing by SEM, EDS, and transmission electron microscopy (TEM). Total strain on each specimen was 5–7%. Creep behavior was found to be consistent with a simplified power law creep equation where creep strain, $\epsilon$, is:

$$\epsilon = A\sigma^n \exp\left(\frac{-Q_a}{RT}\right)$$

In the equation, A is a parameter which incorporates the diffusion constant, Burgers vector magnitude, and grain size dependence of creep, treated as constant by Applicants for this work, $Q_a$ is the apparent activation energy for creep, sigma is the applied creep stress, and n is the creep stress exponent.

Creep specimens were made from boron-modified composition B2 of Table I in the manner described above using a combined room tenmperature pressing step (at 158 MPa) and sintering at 1800 degrees C. in argon for 2 hours) to consolidate the powders (97.8% of theoretical density) to form 5 mm diameter and 5 mm long creep specimens which were polished to provide flat, parallel ends. The specimens had a three phase microstructure composed of tetragonal $Mo_5Si_3$ (T1 phase), cubic $Mo_3Si$ and tetragonal $Mo_5(Si,B)_3$ (T2 phase). Image analysis of the microstructure of sintered specimens indicated that the T1 phase comprised 54% by area of the microstructure with the balance of the microstructure area being T2 phase and $Mo_3Si$ in equal proportions (23 volume % each). Image analysis of sintered specimens indicated that the sintered microstructure contained 2.2% porosity prior to creep testing.

Figure 5:
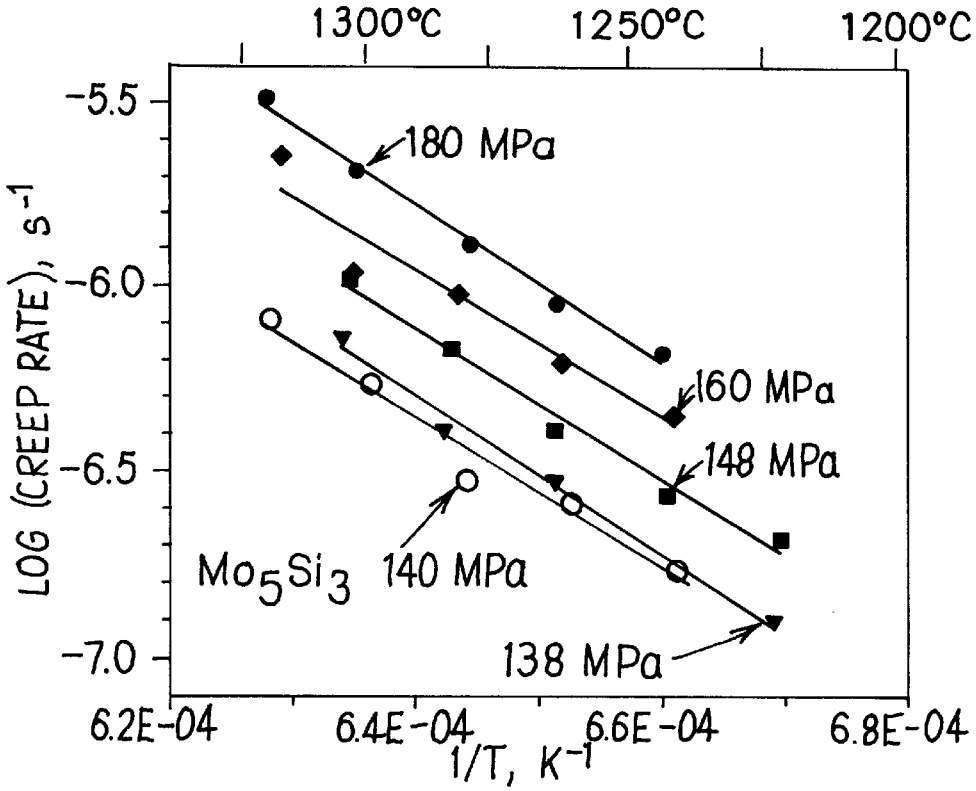
FIG. 5 is an Arrhenius plot of the steady state rate constants for the creep of boron-modified molybdenum silicide material pursuant to the invention (solid data point symbols) and for $Mo_5Si_3$ free of boron for comparison (open data point symbols).

Creep rates for temperatures from 1220–1320 degrees C. and loads of 138–180 MPa are plotted as a function of reciprocal temperature in FIG. 5. Also included in FIG. 5 is the temperature dependence of the creep at 140 MPa of boron free $Mo_5Si_3$ powder consolidated specimens made in similar manner to the boron modified specimens. The creep rate of boron free $Mo_5Si_3$ specimens is slightly lower than that of boron modified composition B2 of Table I under the same deformation conditions. Activation energies for creep determined by least squares fit to the data of FIG. 5 were similar.

Figure 6:
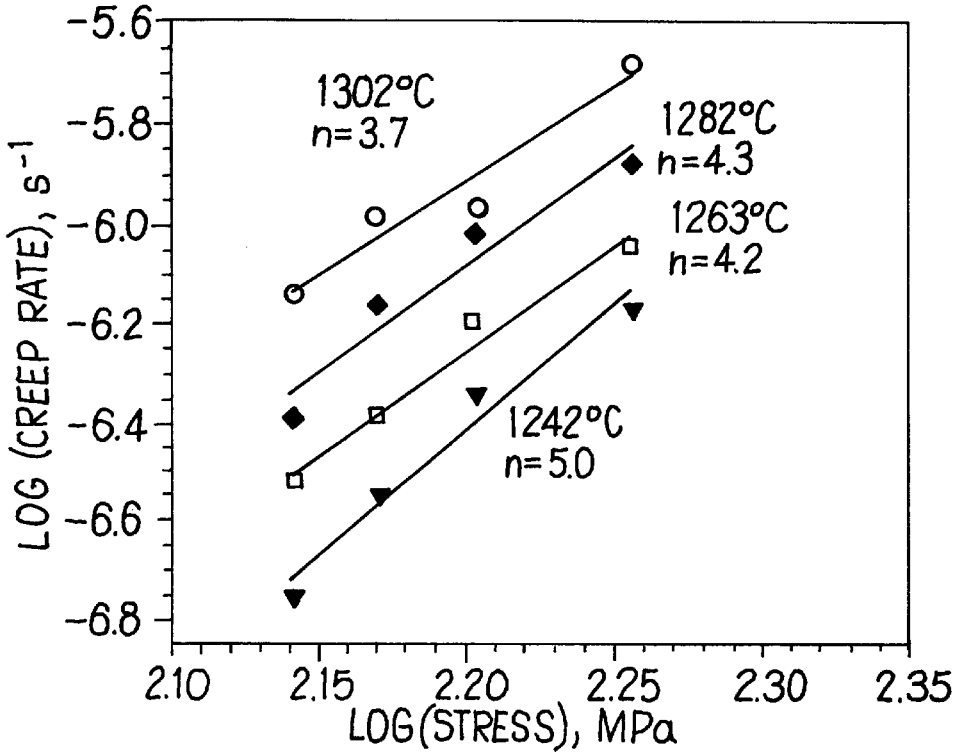
FIG. 6 is a graph of stress dependence of the creep rate for boron-modified molybdenum silicide material pursuant to the invention at different temperatures.

FIG. 6 shows the calculated creep stress exponents, n, for composition B2. The average stress exponent for all conditions tested is 4.3. Stress exponents in this range often indicate creep by dislocation climb.

The creep tests indicated that the effect of boron addition on creep resistance of $Mo_5Si_3$ was small. At small strains, the rate limiting deformation mechanism for the three phase microstructure of boron modified composition B2 appears to be plastic deformation due to disclocation motion or climb within the $Mo_3Si$ and T2 phases. The creep rate may be decreased below that of monolithic $Mo_3Si$ and T2 by partitoning of stress onto creep resistant $Mo_5Si_3$ phase. At larger strains (e.g. 13%), the T1 phase exhibits cracking, indicating that motion of Tl grains is not fully accommodated by plastic strain in $Mo_3Si$ and T2 phases. Cracking in the T1 phase did not propagate through the $Mo_3Si$ and T2 phases, suggesting that these phases exhibit resistance to crack growth at high temperatures.

Figure 7:
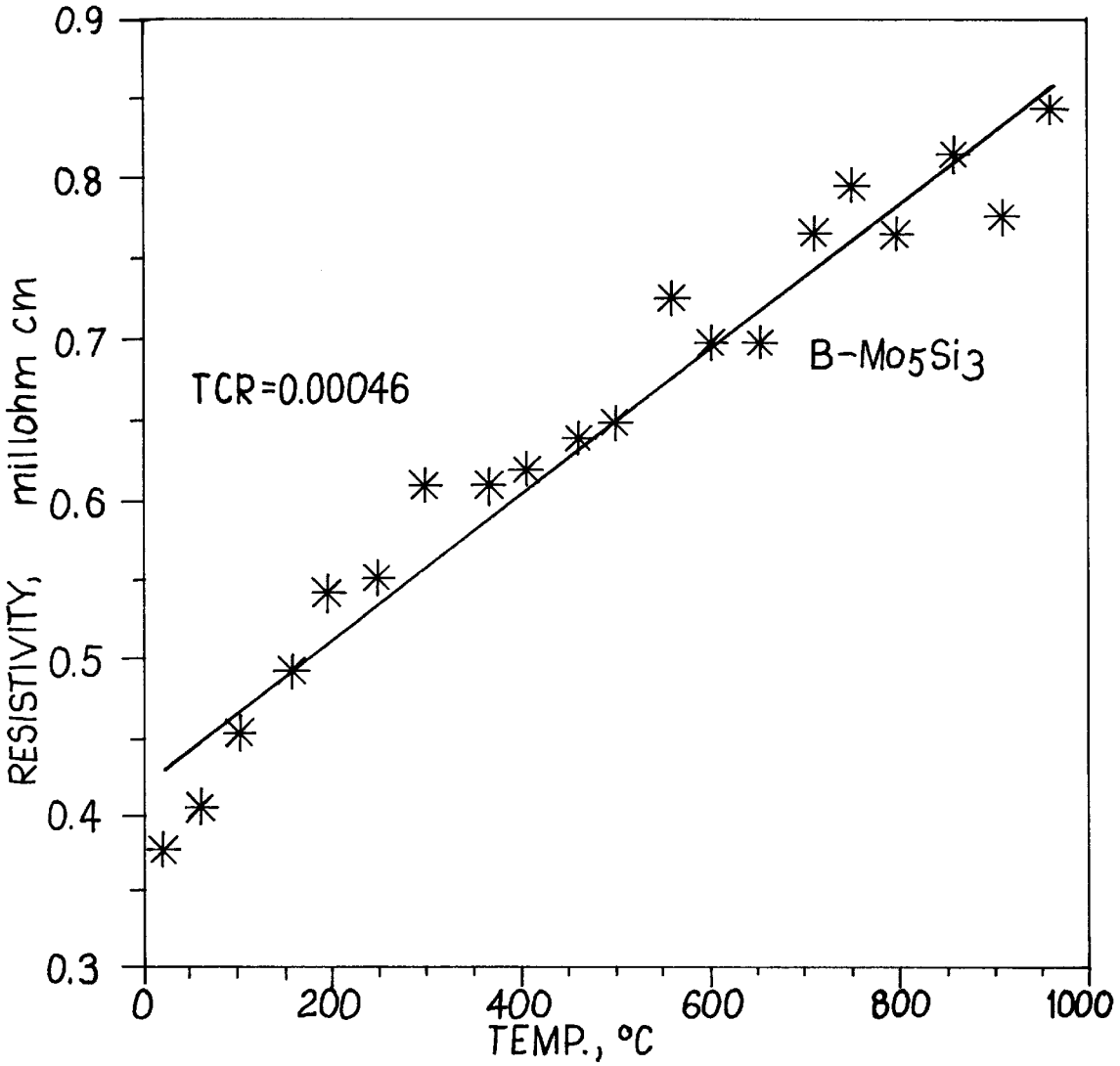
FIG. 7 is a graph of electrical resistivity versus temperature using standard four point DC test method for boron-modified molybdenum silicide material pursuant to the invention showing a linear relationship.

Referring to FIG. 7, a graph of electrical resistivity versus temperature for boron-modified molybdenum silicide material having a $Mo_5Si_3B$ atomic formula is shown and made in the manner described above. The graph indicates a linear relationship between electrical resistivity and temperature. This relationship is advantageous for application of the material as electrical heating elements. The graph also illustrates a temperature coefficient of resistivity (TCR) of $4.6\times10^{-4}$ 1/degrees C. for the boron-modified molybdenum silicide material pursuant to the invention as compared to only $2.1\times10^{-4}$ 1/degrees C. for known Kanthal material ($MoSi_2$). It is apparent that the TRC for the boron-modified molybdenum silicide material pursuant to the invention is greater than twice that of Kanthal material. This TRC parameter of the boron-modified molybdenum silicide material pursuant to the invention is advantageous for applications as electrical heating elements. Moreover, electrical heating elements pursuant to the invention can be used in unsupported spans that are not possible with $MoSi_2$ heating elements as a result of increased creep resistance described above for boron modified molybdenum silicide materials of the invention.

The boron-modified molybdenum silicide material pursuant to the present invention can be fabricated in powder material form into high temperature products using conventional powder consolidation techniques such as extrusion of powders with a fugitive binder for rods and tubes, slip casting, cold pressing of powder by conventional tooling or cold and/or hot isostactic pressing. Powder consolidation typically is followed by sintering and/or hot isostactic pressing. Certain consolidation and sintering and/or pressing parameters are described above for illustration purposes, although the invention is not limited to these particular parameters may be employed to this end. High temperature products into which the boron-modified molybdenum silicide material can be made include electrical components, such as electrical resistors and electrical interconnects, that exhibit sufficient oxidation resistance to withstand high temperatures in service in air as a result of electrical power dissipation, and electrical resistance heating elements that can withstand high temperatures in service in air and other oxygen-bearing atmospheres as well as span greater distances than $MoSi_2$ elements as a result of improved creep resistance compared thereto. The boron-modified molybdenum silicide material pursuant to the present invention also can be fabricated into high temperature structural members and other fabricated components that can withstand high temperatures in service in air or other oxygen-bearing atmospheres while retaining creep resistance associated with $Mo_5Si_3$ for structural integrity. For example, high temperature heat exchanger tubes and high temperature gas turbine engine components such as turbine blades, exhaust shroud or plenum, ignitor, etc. can be fabricated from the boron-modified molybdenum silicide material pursuant to the invention.

Although the invention has been described hereinabove with respect to certain illustrative embodiments of the invention, it is to be understood that modifications and changes can be made therein without departing from the spirit and scope of the invention as set forth in the following claims.

We claim:

1. A molybdenum silicide compound having the composition consisting essentially of about 80 to about 90 weight % Mo, about 10 to about 20 weight % Si, and about 0.1 to about 2 weight % B to improve oxidation resistance of said compound and a microstructure comprising three phases including $Mo_5Si_3$ phase effective to provide high temperature creep resistance and two phases selected from the group consisting of $Mo_3Si$ phase, $MoSi_2$ phase, MoB phase, and a ternary Mo—Si—B phase.

2. The compound of claim wherein the boron to silicon ratio is between about 0.03 and 0.1.

3. Electrical heating element comprising an oxidation resistant boron-modified molybdenum silicide compound consisting essentially of about 80 to about 90 weight % Mo, about 10 to about 20 weight % Si, and about 0.1 to about 2 weight % B to improve oxidation resistance of said compound and a microstructure comprising three phases including $Mo_5Si_3$ phase effective to provide high temperature creep resistance and two phases selected from the group consisting of $Mo_3Si$ phase, $MoSi_2$ phase, MoB phase, and a ternary Mo—Si—B phase.

4. The heating element of claim 3 having a temperature coefficient of resestivity greater than twice that of $MoSi_2$.

5. Electrical component comprising an oxidation resistant boron-modified molybdenum silicide compound consisting essentially of about 80 to about 90 weight % Mo, about 10 to about 20 weight % Si, and about 0.1 to about 2 weight % B to improve oxidation resistance of said compound and a microstructure comprising three phases including $Mo_5Si_3$ phase and two phases selected from the group consisting of $Mo_3Si$ phase, $MoSi_2$ phase, MoB phase, and a ternary Mo—Si—B phase.

6. The component of claim 5 which is an electrical resistor.

7. The component of claim 5 which is an electrical interconnect.

8. A high temperature structural member comprising an oxidation resistant boron-modified molybdenum silicide compound consisting essentially of about 80 to about 90 weight % Mo, about 10 to about 20 weight % Si, and about 0.1 to about 2 weight % B to improve oxidation resistance of said compound and a multiphase microstructure comprising three phases including $Mo_5Si_3$ phase effective to impart high temperature creep resistance and two phases selected from the group consisting of $Mo_3Si$ phase, $MoSi_2$ phase, MoB phase, and a ternary Mo—Si—B phase.

9. A gas turbine engine component comprising an oxidation resistant boron-modified molybdenum silicide compound consisting essentially of about 80 to about 90 weight % Mo, about 10 to about 20 weight % Si, and about 0.1 to about 2 weight % B to improve oxidation resistance of said compound and a microstructure comprising three phases including $Mo_5Si_3$ phase effective to impart high temperature creep resistance and two phases selected from the group consisting of $Mo_3Si$ phase, $MoSi_2$ phase, MoB phase, and a ternary Mo—Si—B phase.

10. A component consisting of molybdenum silicide compound having the composition comprising about 80 to about 90 weight % Mo, about 10 to about 20 weight % Si, and about 0.1 to about 2 weight % B to improve oxidation resistance of said compound, a microstructure comprising three phases including $Mo_5Si_3$ phase effective to provide high temperature creep resistance and two phases selected from the group consisting of $Mo_3Si$ phase, $MoSi_2$ phase, MoB phase, and a ternary Mo-Si-B phase, and a scale including borosilicate glass formed by exposure to high temperature to close scale porosity for oxidation resistance.

* * * * *

UNITED STATES PATENT AND TRADEMARK OFFICE
CERTIFICATE OF CORRECTION

PATENT NO : 5,865,909

DATED : Feb. 2, 1999

INVENTOR(S) : Mitchell K. MEYER et al.

It is certified that error appears in the above-identified patent and that said Letters Patent is hereby corrected as shown below:

Column 9, line 31;

After "claim" insert -1-.

Column 9, line 44;

"resestivity" should be -resistivity-.

Signed and Sealed this

Tenth Day of April, 2001

*Attest:*

Nicholas P. Godici

NICHOLAS P. GODICI

*Attesting Officer*

*Acting Director of the United States Patent and Trademark Office*